United States Patent [19]

Curtis et al.

[11] 4,363,740

[45] Dec. 14, 1982

[54] PROCESS FOR MAKING CONTROLLED SUDSING DETERGENT POWDER

[75] Inventors: Michael Curtis, Irby, England; Peter R. Garrett, Pantymwyn; John Mead, Ewloe, both of Wales

[73] Assignee: Lever Brothers Company, New York, N.Y.

[21] Appl. No.: 285,675

[22] Filed: Jul. 21, 1981

[30] Foreign Application Priority Data

Jul. 29, 1980 [GB] United Kingdom ..... 8024742

[51] Int. Cl.[3] ..... C11D 17/00

[52] U.S. Cl. ..... 252/91; 252/174.13; 252/174.16

[58] Field of Search ..... 252/321, 358, 91, 174.13, 252/174.16

[56] References Cited

U.S. PATENT DOCUMENTS 3,519,570 7/1970 Bruce ..... 252/135

3,886,098 5/1975 DiSalvo et al. ..... 252/174.13

FOREIGN PATENT DOCUMENTS 2406455 8/1975 Fed. Rep. of Germany ..... 252/174.13

2354381 12/1976 France ..... 252/174.13

1571501 7/1980 United Kingdom .

*Primary Examiner*—Shrive P. Beck

*Attorney, Agent, or Firm*—Irving N. Feit; James J. Farrell

[57] ABSTRACT

A process for manufacturing a low sudsing fabric washing powder in which a mixture of a suds-suppressant, such as an alkyl phosphoric acid ester or a salt thereof, and a hydrophobic material such as a petroleum jelly or a natural or synthetic wax is combined with a spray-dried detergent powder. The temperature of the powder at which combination takes place is lower than the drop-melting point of the mixture of suds-suppressant and hydrophobic material.

7 Claims, No Drawings

PROCESS FOR MAKING CONTROLLED SUDSING DETERGENT POWDER

This invention relates to a process for the production of controlled sudsing fabric washing powders and to the powders produced by the process.

Controlled sudsing detergent compositions containing the combination of a suds-suppressant and a hydrophobic material have been described in the literature. For example, detergent compositions containing silanated silica, or silica treated in some other way so as to render its surface hydrophobic, in combination with a hydrophobic wax or oil, have been described. The combination of a salt of alkylphosphoric acid as suds-suppressant and a wax as hydrophobic material is disclosed in DOLS No. 2701664 and the same specification discloses a process for incorporating this combination into a fabric washing powder by spraying in melt form onto powdered material, either spray-dried detergent base powder or base powder admixed with sodium perborate.

In a conventional plant for the manufacture of detergent powders by spray-drying and dry-dosing techniques, it is normal practice to combine components not normally spray-dried but not heat-sensitive, with the spray-dried powder whilst it is still quite hot or at least warm.

We have now discovered that the temperature of the spray-dried powder, or of the combined spray-dried powder and dry-dosed components with which the suds-suppressant hydrophobic material combination is combined is an important factor in the effectiveness of the suds suppression produced.

Accordingly the present invention provides a process for the production of a controlled sudsing fabric washing powder which comprises the steps of (a) preparing a spray-dried base powder and (b) combining it with a suds-suppressant/hydrophobic material combination characterised in that the temperature of the spray-dried base powder, or of the mixture containing it, is lower than the drop melting point of the suds suppressant/hydrophobic material combination.

The term 'drop melting point' used herein is used in the sense defined in ASTM designation D127-63.

We consider that some benefit is exhibited immediately the temperature of the powder falls below the drop melting point of the suds-suppressant/hydrophobic material combination. However we have observed that two situations arise according to whether the combination cools to a solid, as it does for example when a wax is used as the hydrophobic material, or whether it cools to a gel as it does when petroleum jelly is used as the hydrophobic material. In the latter case we prefer to operate the process so that the temperature of the spray-dried base powder is at least 15° C. below the drop melting point.

Accordingly, in a preferred aspect of the process of this invention, when the suds-suppressant/hydrophobic material combination cools to a solid, the temperature of the base powder is lower than the drop melting point of the combination, and when it cools to a gel, the temperature of the base powder is at least 15° C. below the drop melting point of the suds-suppressant/hydrophobic material combination.

A gel, in the sense used in this specification is a substance which even when it has a measurable yield stress value, contains more than 50% by weight of liquid. A large number of suds-suppressants can be used in the process of this invention including fatty acids and their water-insoluble salts, hydrophobic silicas and alkyl phosphoric acids and their water-soluble or water-insoluble salts, of which the alkylphosphoric acids and their salts are preferred.

Preferably, the hydrophobic material used in the process of the invention is a wax or petroleum jelly and, without wishing to be limited by theory, we believe that the effect produced by the process of the invention is due to the intimately mixed form of the suds-suppressant/wax or suds-suppressant/jelly combination being "frozen" together into the powder.

In conventional detergent powder processing, the spray-dried powder is normally combined with post-dosed components such as sodium perborate, sodium sulphate, enzyme compositions and perfume in a dry-dosing step. This step may be performed in accordance with the invention, either prior to, simultaneously with, or after the combining of the spray-dried base powder with the suds-suppressant/hydrophobic material combination.

Although the components of the spray-dried powder are not believed to be really essential to the achievement of the technical effect, the powders will normally contain a surfactant, preferably an anionic and/or nonionic surfactant, and it is preferred that they should do so. Other components which will normally be present comprise detergency builders, corrosion inhibitors, antiredeposition agents, fluorescers, stabilisers and a substantial proportion of moisture.

Typical anionic surfactants, which may be present in amounts of from about 2 to 35% by weight of the finished powder, are sodium alkylbenzene sulphonates, preferably the $C_{10}$–$C_{14}$ alkyl compounds, sodium primary and secondary alkyl sulphates, preferably the $C_{10}$–$C_{22}$ alkyl sulphates, sodium olefine sulphonates, preferably the $C_{10}$–$C_{18}$ sulphonates and sodium alkane sulphonates. Soaps of fatty acids may also be present, preferably the sodium and potassium salts of $C_{10}$–$C_{22}$ fatty acids, both saturated and mono-saturated. Where soap is the sole anionic surfactant it may be present in an amount up to about 65% by weight of the finished composition, down to about ½% by weight when other anionic surfactants are present. Typical soaps which can be used are those formed from coconut oil, tallow and natural oils containing high proportions of oleic acid such as sunflower oil.

The powders produced by the process of the invention can also contain nonionic surfactants, preferably ethoxylated primary and secondary alcohols of from 8 to 25 carbon atoms containing from 3 to 25 moles of ethylene oxide per mole of alcohol. These materials may be present in an amount of from 1 to 15% by weight, based on the weight of the finished powder.

Typical detergency builders which can be used are the water-soluble phosphates, carbonates, percarbonates and aluminosilicates, particularly the sodium and potassium salts of these compounds. Organic builders may also be used, examples being sodium carboxymethyloxysuccinate, sodium citrate, sodium polyacrylates and sodium nitrilotriacetate. Any of these compounds, or any other builder compound, in any suitable mixture, may be used in amounts of from 5 to 50% by weight of the finished powder.

The process of the invention is based on a conventional plant for the spray-drying of detergent powders comprising slurry-making apparatus, a spray-drying tower and equipment for transporting the spray-dried powder to a post-dosing stage, where the powder is combined with additional components to form the finished powder.

In one example of a process in accordance with the invention, the liquid or molten suds-suppressant/hydrophobic material combination is sprayed onto cooled powder as it falls from one level in the plant to another, for example from one conveyor belt to another. In a second process, the mixture is sprayed onto the powder as it passes a spraying station on a conveyor belt. In a third process, the cooled powder can be combined, for example sprayed, with liquid or molten suds-suppressant/hydrophobic material in any mixer designed for liquid solid mixing, for example a rotating drum mixer.

Whichever method of carrying out the process is chosen, it is preferred that the amount of suds-suppressant/hydrophobic material combination chosen should be from 0.1 to 5% by weight, based on the weight of the finished powder.

The preferred suds-suppressant/hydrophobic material combination comprises the following components:

(i) a hydrocarbon having a drop melting point of from 20° to 120° C., preferably from 45°-65° C.; and (ii) an alkyl phosphoric acid.

The alkyl phosphoric acid should have the general formula:

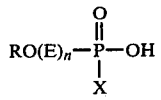

where

X is hydroxyl or $R'O(EO)_m$;

R and R' are the same or different $C_{12-24}$, preferably $C_{16}$–$C_{22}$, straight or branched chain, saturated or unsaturated alky groups, especially $C_{16}$–$C_{18}$ linear saturated alkyl groups;

m and n are the same or different and are O or an integer of from 1 to 6; and

EO is an ethylene-oxy or propylene-oxy group or a random or block mixture thereof, or a water-soluble or insoluble salt thereof.

In practice, the compounds are commonly mixtures of both mono- and di-alkyl phosphoric acids, with a range of alkyl chain lengths. Predominantly mono-alkyl phosphates are usually made by phosphorylation of alcohols, or ethoxylated when m or n is 1 to 6, using a phosphoric acid. Phosphorylation may alternatively be accomplished using phosphorus pentoxide, in which case the mixed mono- and di-alkyl phosphates are produced. The substituted phosphoric acids of formula I above are used in either water-soluble or water-insoluble form, that is, either as a partial or full salt of a cation such as sodium, potassium, calcium, magnesium, aluminium, barium or zinc. Mixtures of insoluble alkyl phosphoric acid salts with soluble ones, or with the free alkyl phosphoric acid may also be used.

When the free alkyl phosphoric acid is added to the detergent composition in acid form, it will of course be neutralised, usually to form the sodium salt, when the detergent composition is in aqueous alkaline solution, and in hard water some calcium or magnesium salt is formed in situ.

Preferred alkyl phosphoric acids are the mono-alkyl acids containing from 16 to 22 carbon atoms and the sodium salts thereof, particularly the material sold under the registered trade mark "Alf 5" by Diamond Shamrock Europe Limited, which includes a mixture of mono- and di-$C_{16-18}$ alkyl phosphoric acids and a little free acid and free alcohol.

The hydrophobic materials for use in the detergent compositions manufactured by the process of the invention are water-insoluble materials of either synthetic, mineral, vegetable or animal origin, which are dispersible in detergent solution. Preferred materials are waxes, oils and mixtures thereof.

The waxes should have a drop melting point of between about 20° and 120° C., preferably not more than 90° C. and especially in the range 45° to 65° C. The preferred waxes are of mineral origin, especially those derived from petroleum, including microcrystalline and oxidised microcrystalline petroleum waxes and paraffin waxes. A preferred material is petroleum jelly (often sold under the trade mark "Vaseline" by Cheseborough-Ponds Limited). Synthetic waxes, or Montan waxes, or natural waxes such as beeswax, candelilla and carnauba waxes may also be used if desired. Any of these waxes described may be used along or in admixture with other waxes.

The third most preferred hydrophobic material for use in the process of the invention is a liquid hydrocarbon oil. Examples of liquid hydrocarbon oils are mineral, vegetable or animal oils, colourless mineral oils being preferred. Either light or heavy mineral oil or mixtures thereof may be employed but, of course, any liquid hydrocarbon used must be of low volatility at normal fabric-washing temperatures. Other oils which are suitable are sesame oil, cottonseed oil, corn oil, sweet almond oil, olive oil, wheat germ oil, rice bran oil or peanut oil, or animal oils such as lanolin, neat's foot oil, bone oil, sperm oil or cod liver oil.

Subject to the proviso that the ratio of the amount of the suds-suppressant to the hydrophobic material lies in the range of from 1:9 to 9:1 parts by weight, the amount of the hydrophobic material in the finished detergent composition may be from about 0.1 to about 5% by weight, preferably about 0.5 to about 3% by weight of the composition. Similarly, subject to the same proviso, the amount of the suds-suppressant in the detergent composition will also normally be from 0.1 to 5% by weight of the finished composition.

The process of the invention will be further described by means of the following Examples.

EXAMPLE 1

A fabric washing powder having the following formulation was prepared by conventional slurry-making and spray-drying techniques.

| | Parts by weight |
|---|---|
| Sodium alkylbenzene ($C_{12}$) sulphonate | 8.0 |
| Primary $C_{12-15}$ alcohol ethoxylate 7EO | 3.0 |
| Sodium silicate | 8.0 |
| Sodium tripolyphosphate | 35.0 |
| Sodium sulphate | 7.0 |
| Sodium carboxymethylcellulose | 1.0 |
| Moisture, fluorescers and stabilisers | 14.0 |

A suds-suppressant/hydrophobic material combination consisting of a molten mixture of one part of a $C_{16}/C_{18}$ alkyl phosphoric acid ester with three parts of petroleum jelly with a drop melting point of 54° C. was then sprayed onto this spray-dried base powder as it fell in a cascade from one conveyor belt to another.

Two experiments of this type were performed, one using hot spray-dried powder at a temperature of 75°–85° C., the other using cold powder at 20°–30° C., and each experiment was duplicated at different levels of suds-suppressant/hydrophobic material.

The spray-dried powder was then mixed with 24 parts of a mixture of sodium perborate tetrahydrate and perfume.

The degree of suds-control of each of the powders produced was then assessed as follows:

2½ kg loads of white terry cotton towelling were washed in Hoover (registered trade mark) front-loading automatic washing machines using a water of 26° H. hardness and 200 g of powder. The washing programme which was selected washes at 85° C.

The suds height of each wash liquor was measured using an arbitrary scale attached to the window of the machines. Each suds assessment was performed four times, the average suds height being quoted in Table 1.

TABLE 1

| Experiment No | Powder Temperature (°C.) | % alkyl phosphoric acid/petroleum jelly combination | Foam Height (cms) |
|---|---|---|---|
| 1 | 75–85 | 1.7 | 10 |
| 2 | 75–85 | 1.2 | 16 |
| 3 | 20–30 | 1.7 | trace |
| 4 | 20–30 | 1.2 | trace |

The adverse affect of higher powder temperature on suds-control performance can be seen from comparing Experiment 1 with 3 and 2 with 4.

EXAMPLE 2

In a similar experiment to that described in Example 1 the following formulation was prepared.

| | Parts by weight |
|---|---|
| Sodium alkylbenzene sulphonate | 6.0 |
| Primary $C_{12}$–$C_{15}$ alcohol ethoxylate 7EO | 4.0 |
| Sodium silicate | 9.0 |
| Sodium tripolyphosphate | 35.0 |
| Sodium sulphate | 14.5 |
| Sodium carboxymethyl cellulose | 1.0 |
| Moisture, fluorescers and stabilisers | 10.5 |
| Sodium perborate tetrahydrate | 20.0 |

This powder was then divided into two batches, A and B, both of which were used in a model experiment in which 1 part of a molten combination of suds-suppressant and hydrophobic material was sprayed from a syringe onto 100 parts of powder held at different temperatures. The powder was agitated using a domestic mixer/blender with a regime of 0.5 minutes blending and 8 minutes mixing.

The effectiveness of the suds control obtained was then assessed as follows:

3 kg loads of white terry cotton towelling and cotton sheeting were washed in Miele (registered trade mark) front loading automatic washing machines using water of 24° H. hardness and 150 g of powder. A main wash programme giving an end-of-wash temperature of 90° C. was used.

The suds height of each wash liquor was measured using an arbitrary scale attached to the window of the machines. Each model experiment was repeated—the average foam heights after 30 minutes and at the end of the wash (45 minutes) being quoted in Table 2.

In column A of Table 2 the suds heights are quoted using a mixture of 3 parts by weight of petroleum jelly to 1 part by weight of commercial alkyl ($C_{16-18}$) phosphoric acid ester as the suds suppressant/hydrophobic material combination. At temperatures below the drop melting point of 58° C. the mixture was a gel.

In column B of Table 2 the suds heights are quoted using a mixture of 3 parts by weight of Shell wax 125/30 and 1 part of commercial alkyl $C_{16}$–$C_{18}$ phosphoric acid ester as the suds suppressant/hydrophobic material combination. At temperatures below the drop melting point of 54° C. this mixture was a solid.

TABLE 2

| Temperature of Powder °C. | Suds Heights (Arbitary Units) 30 mins A | 30 mins B | 45 mins A | 45 mins B |
|---|---|---|---|---|
| 25 | 0.7 | 3.9 | 1.7 | 4.0 |
| 40 | 2.1 | 4.0 | 4.0 | 5.0 |
| 50 | 4.2 | 3.5 | 5.0 | 5.5 |
| 55 | 4.7 | 10 | 5.2 | 7.5 |
| 60 | 5.0 | 10 | 6.0 | 9.0 |
| 65 | 5.7 | 10 | 6.0 | not determined |
| 75 | 5.7 | 10 | 6.0 | 8.5 |

It can be seen from Table 2 that in the case of a suds-suppressant/hydrophobic material combination cooling to a gel the suds-suppressant effect is most marked when the combination is sprayed onto a powder at a temperature at least 15° C. below the drop melting point of the combination.

It can also be seen from Table 2 that in the case of a suds-suppressant/hydrophobic material combination cooling to a solid there is a sharp improvement in suds control performance at the drop melting point.

What is claimed is:

1. A process for the production of a controlled sudsing fabric washing powder having improved suds suppression effectiveness comprising the steps of:
   (a) heating a suds-suppressant/hydrophobic material combination to a temperature above its drop melting point;
   (b) combining the suds-suppressant/hydrophobic material combination heated to said temperature above its drop melting point with a spray-dried base powder maintained at a temperature below said drop melting point; and
   (c) cooling said suds-suppressant/hydrophobic material combination to a solid or gel.

2. A process for the production of a controlled sudsing fabric washing powder according to claim 1 wherein the spray-dried powder is maintained at least 15° C. below the drop melting point of the suds-suppressant/hydrophobic material combination and said combination cools to a gel.

3. A process for the production of a controlled sudsing fabric washing powder according to claim 1 or 2 wherein the suds suppressant/hydrophobic material combination is sprayed in liquid or molten form onto the spray-dried base powder.

4. A process for the production of a controlled sudsing fabric washing powder according to claim 1 or 2 wherein the base powder is admixed with sodium perborate or sodium percarbonate prior to combining with the suds suppressant/hydrophobic material combination.

5. A process for the production of a controlled sudsing fabric washing powder according to claim 1 or 2 wherein the suds suppressant comprises an alkyl phosphoric acid or a water-soluble or water-insoluble salt thereof.

6. A process for the production of a controlled sudsing fabric washing powder according to claim 1 wherein the hydrophobic material comprises a wax which cools to a solid.

7. A process for the production of a controlled sudsing fabric washing powder according to claim 2 wherein the hydrophobic material comprises petroleum jelly which cools to a gel.

* * * * *